US006766604B1

(12) United States Patent
Jones

(10) Patent No.: US 6,766,604 B1
(45) Date of Patent: Jul. 27, 2004

(54) INTRAVENOUS FLUID BAG PROMOTIONAL APPARATUS WITH CLOCK

(75) Inventor: Brenda S. Jones, Raleigh, NC (US)

(73) Assignee: Adstracts, Inc., Raleigh, NC (US)

( * ) Notice: Subject to any disclaimer, the term of this patent is extended or adjusted under 35 U.S.C. 154(b) by 0 days.

(21) Appl. No.: 09/540,426

(22) Filed: Mar. 31, 2000

(51) Int. Cl.[7] ..... G09F 1/08
(52) U.S. Cl. ..... 40/538; 40/584; D10/6
(58) Field of Search ..... 40/538, 584, 306, 40/310, 312, 439; D10/6

(56) References Cited

U.S. PATENT DOCUMENTS 3,872,235 A * 3/1975 Manly, Jr. ..... 174/52
4,542,826 A * 9/1985 Adams ..... 206/427
5,135,485 A * 8/1992 Cohen et al. ..... 604/67
D367,427 S * 2/1996 Kogler ..... D10/2
5,556,258 A * 9/1996 Lange et al. ..... 417/63
D448,309 S * 9/2001 Jones ..... D10/6

* cited by examiner

*Primary Examiner*—Cassandra Davis
(74) *Attorney, Agent, or Firm*—Myers Bigel Sibley & Sajovec

(57) ABSTRACT

A novel promotional apparatus is provided and includes an intravenous fluid bag replica having a clock thereon. The promotional apparatus is configured to be vertically suspended from the arm of a stand. The intravenous fluid bag replica may also be mounted to a wall or may be supported at an angle by a desktop stand.

10 Claims, 5 Drawing Sheets

INTRAVENOUS FLUID BAG PROMOTIONAL APPARATUS WITH CLOCK

FIELD OF THE INVENTION

The present invention relates generally to product promotion and, more particularly, to the promotion of healthcare-related products.

BACKGROUND OF THE INVENTION

The use of promotional items has proliferated in today's increasingly competitive marketplace, where companies are constantly seeking more effective and new ways to market their products. In the healthcare industry, physicians and other healthcare providers often receive promotional articles from vendors of healthcare-related products, such as pharmaceutical products. These promotional articles often include "everyday" items, such as writing pads, calendars, and pens that have promotional information (indicia) printed thereon. For example, pharmaceutical companies often provide physicians with writing pens having the name of a particular pharmaceutical product printed thereon with the hopes that the pens will help remind the physicians to prescribe the particular pharmaceutical product.

Unfortunately, because of lack of distinctiveness, many promotional articles provided to healthcare providers often become "lost-in-the-shuffle" with other promotional articles. Thus, there is a need for distinctive, more effective promotional products directed to physicians and other healthcare providers.

SUMMARY OF THE INVENTION

In view of the above discussion, a novel promotional apparatus is provided and includes a transparent, flexible intravenous fluid bag replica having a clock thereon. Promotional indicia is preferably provided on the intravenous fluid bag. The flexible intravenous fluid bag replica is configured to be suspended from the arm of a stand to resemble an intravenous fluid bag in operation. According to other embodiments, the clock may be configured to be mounted directly to a wall, or may be supported at an angle via cradles or desktop stands.

According to another embodiment of the present invention, a flexible intravenous fluid bag may be formed from a pair of flexible, transparent polymeric sheet panels disposed substantially parallel to each other and joined along respective peripheral edges thereof to form a pouch. In addition, at least one of the transparent polymeric sheet panels may include promotional indicia for a healthcare product thereon.

A clock, such as a digital clock, is mounted on one of the flexible polymeric sheet panels. A stand configured to suspend the pouch vertically to resemble an intravenous fluid bag in operation may also be provided.

According to another embodiment of the present invention, a promotional apparatus includes a rigid, transparent block having a shape that resembles an intravenous fluid bag with a clock mounted thereto Preferably, a cavity is formed within a face of the, block and a portion of the clock is disposed within the cavity.

Accordingly, the present invention provides distinctive promotional apparatus that may be especially effective when directed to healthcare providers.

DETAILED DESCRIPTION OF THE INVENTION

Figure 1:
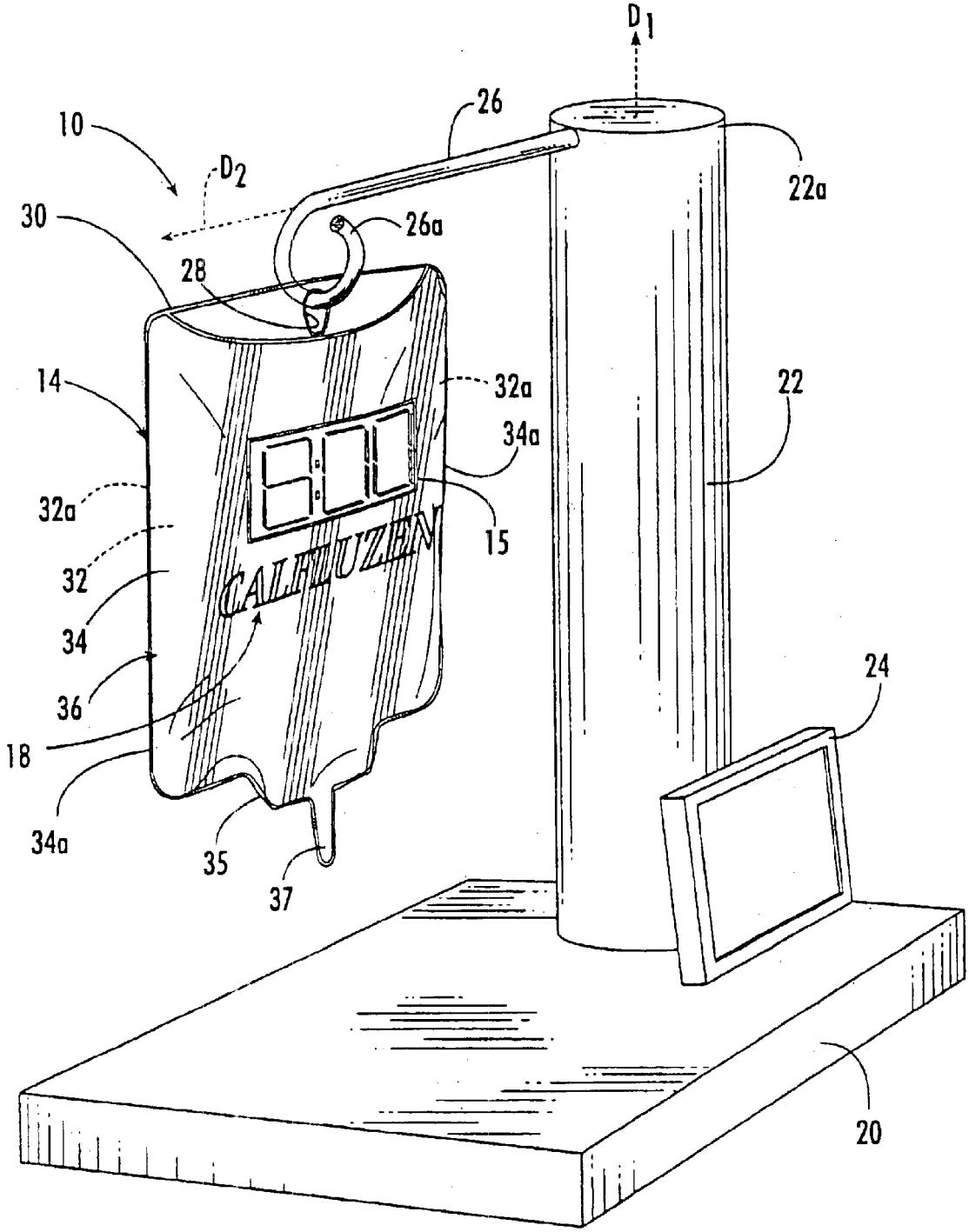
FIG. 1 is a perspective view of an intravenous fluid bag having a clock thereon and vertically suspended from a stand according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout the description of the drawings.

Referring now to FIG. 1, a promotional apparatus 10 according to an embodiment of the present invention is illustrated. The illustrated promotional apparatus 10 includes a stand 12 and an intravenous fluid bag 14 suspended from the stand 12 to resemble an intravenous fluid bag in operation. A digital clock 15 is attached to the flexible intravenous fluid bag 14, as illustrated. It is also understood that the present invention is not limited to digital clocks. Various types and configurations of clocks can be utilized in accordance with the present invention, without limitation. Furthermore, the clock 15 may be attached to any portion of the intravenous fluid bag 14. In addition, promotional indicia 18 is disposed on the intravenous fluid bag 14.

In the illustrated embodiment, the stand 12 includes a base 20. An elongated column 22 with a free end 22*a* extends upwardly from the base 20 along a first direction $D_1$. The illustrated stand also includes a card holder 24 disposed on the base 20. The illustrated card holder 24 is configured to display business cards and other similar-sized articles. An elongated arm 26 extends outwardly from the elongated column 22 adjacent the elongated column free end 22*a* and along a second direction $D_2$. As illustrated, the second direction $D_2$ is transverse to the first direction $D_1$. Preferably, when the base 20 is supported on a horizontal surface, $D_1$ is a substantially vertical direction and $D_2$ is a substantially horizontal direction.

The elongated arm 26 includes a generally hook-shaped free end 26*a*. In the illustrated embodiment, the flexible intravenous fluid bag 14 is suspended vertically from the elongated arm free end 26*a* via an aperture 28 formed in an upper end 30 of the intravenous fluid bag 14.

The illustrated promotional apparatus 10 may be formed from two flexible, transparent polymeric sheet panels 32, 34 joined along respective peripheral edges 32*a*, 34*a* thereof to form a pouch 36 having the distinctive shape of an intravenous fluid bag. At a lower end 35, the peripheral edges 32*a*, 34*a*, are joined to form a protruding portion 37 that resembles tubing extending from an intravenous fluid bag.

The illustrated panels 32, 34 are preferably formed from thermoplastic material. Exemplary thermoplastic material out of which the illustrated panels 32, 34 may be formed includes, but is not limited to, polystyrene, acrylonitrile-butadiene-styrene (ABS), polycarbonate, polyvinylchloride (PVC), and acrylic.

The illustrated panels 32, 34 have generally rectilinear configurations. However, it is understood that the panels 32, 34 may have other shapes and configurations as long as the resulting pouch 36 has the distinctive, recognized appearance of an intravenous fluid bag. The peripheral edges 32*a*, 34*a* of the panels 32, 34 are preferably heat welded to give the appearance of an actual intravenous fluid bag. However, the peripheral edges 32*a*, 34*a* may be joined in various ways as would be understood by one of skill in the art.

Figure 2:
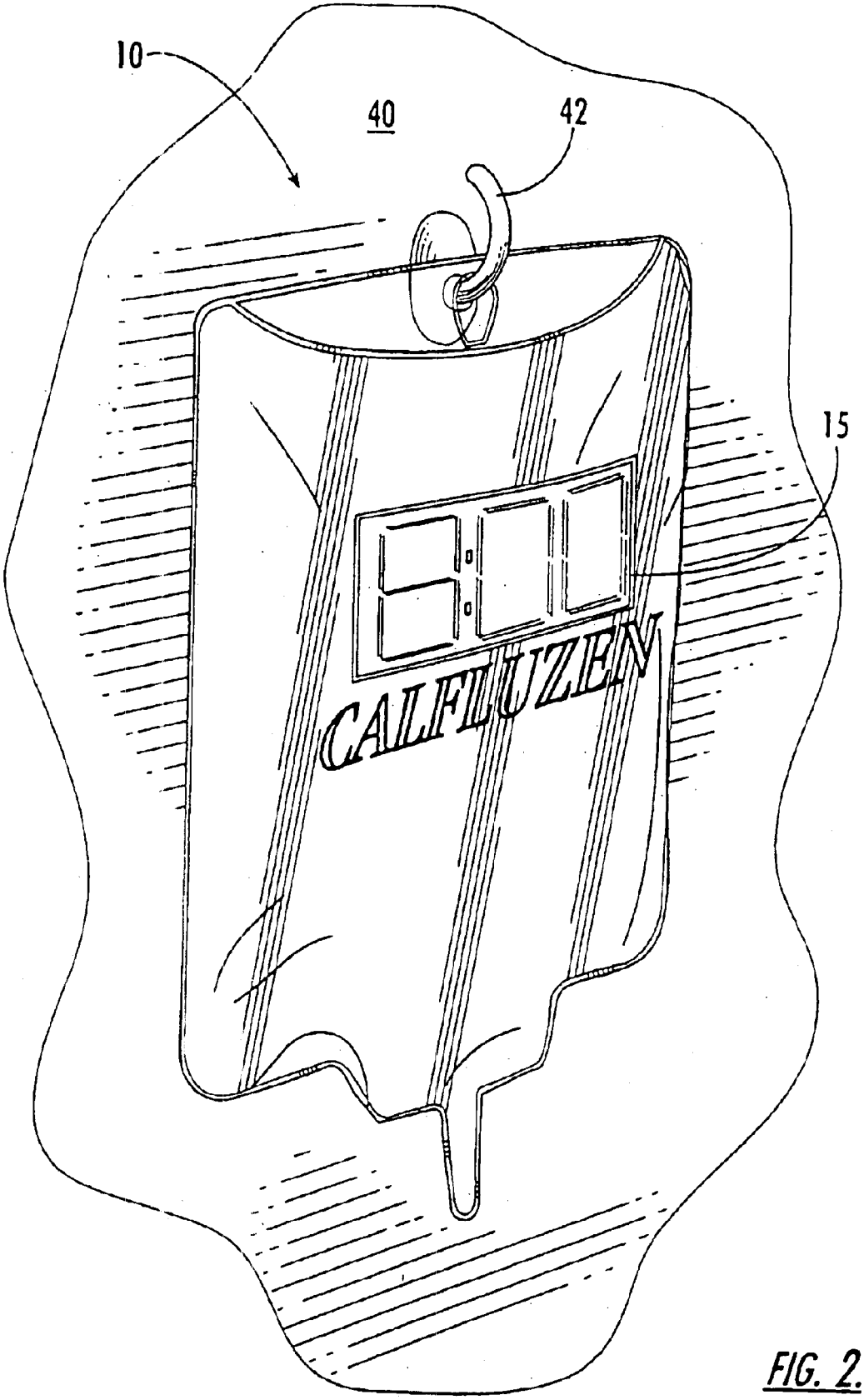
FIG. 2 is a perspective view of the intravenous fluid bag of FIG. 1 suspended from a wall-mounted hook.
Figure 3:
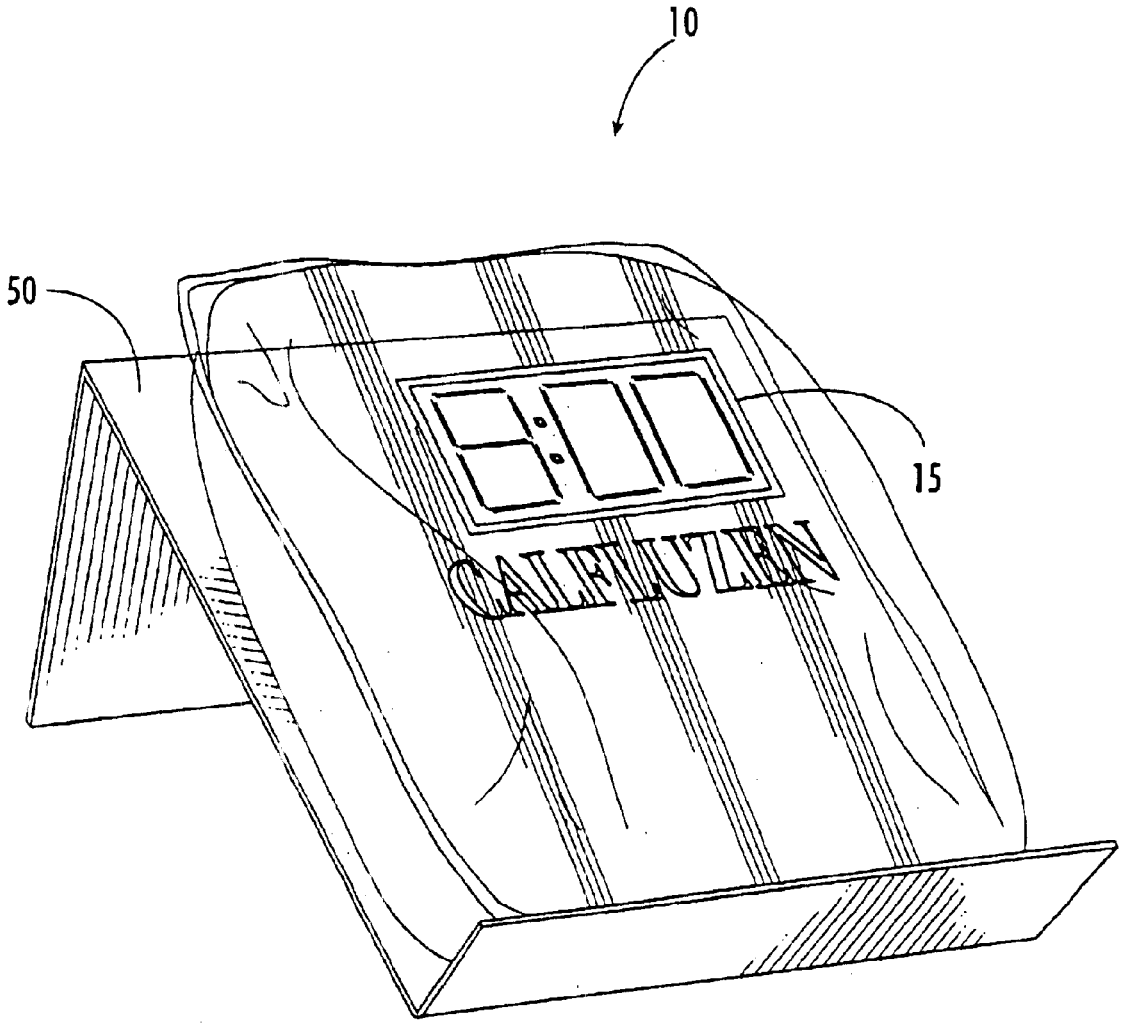
FIG. 3 is a perspective view of the intravenous fluid bag of FIG. 1 supported within a desktop support.

Referring to FIG. 2, the intravenous fluid bag 14 of FIG. 1 may be mounted to a wall 40 or other generally vertical surface via a hook 42, as illustrated. Referring to FIG. 3, the intravenous fluid bag 14 of FIG. 1 may be supported by a desktop stand 50 such that when the desktop stand is supported on a horizontal surface, the intravenous fluid bag 14 is supported at an angle relative to the horizontal surface.

Figure 4:
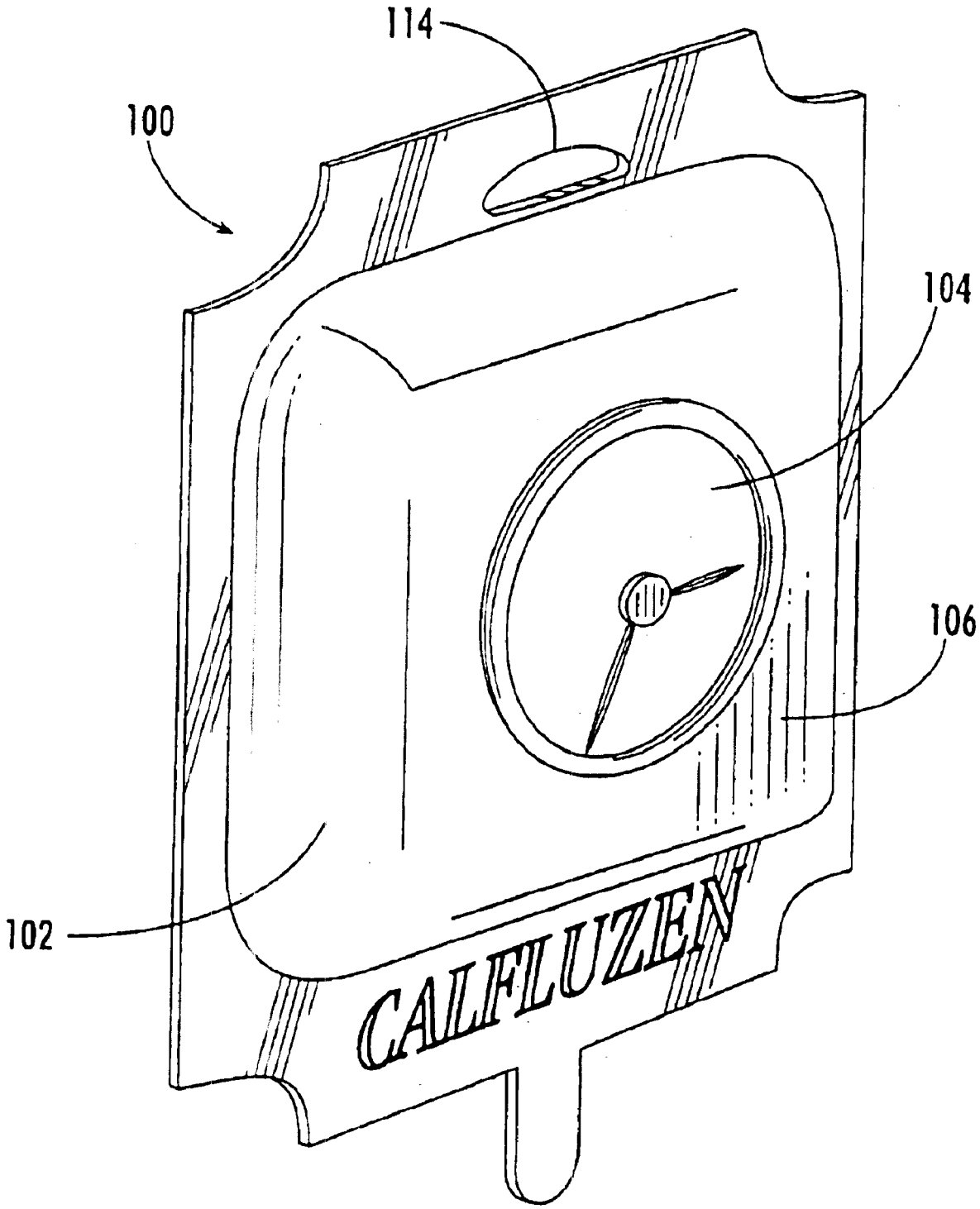
FIG. 4 is a perspective view of a promotional apparatus having the distinctive shape of an intravenous fluid bag and having a clock disposed thereon according to another embodiment of the present invention.
Figure 5:
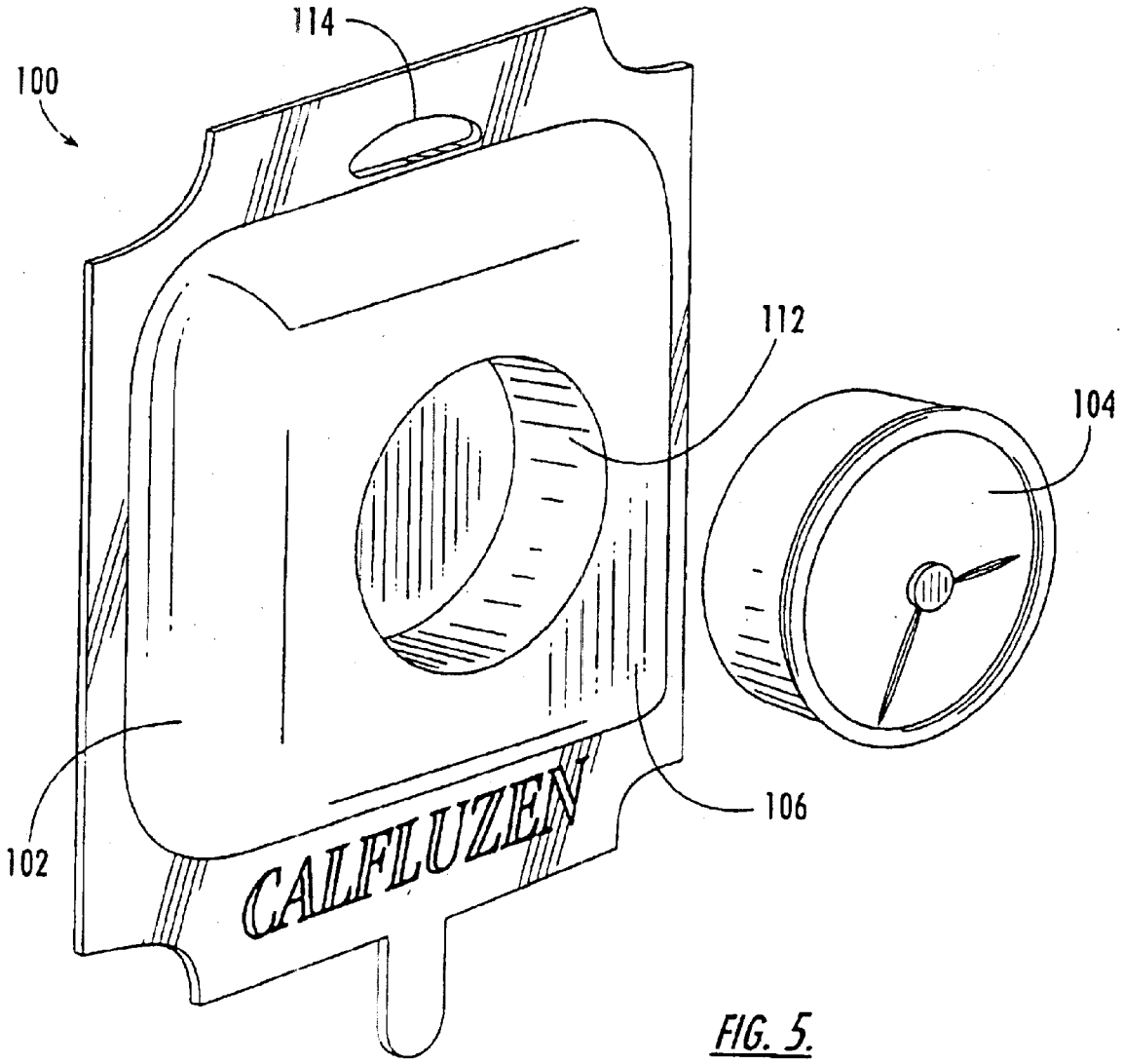
FIG. 5 is an exploded perspective view of the promotional apparatus of FIG. 4.

Referring now to FIGS. 4 and 5, a promotional apparatus 100 according to another embodiment of the present invention is illustrated. The illustrated promotional apparatus 100 includes a rigid, transparent block 102 having a shape that resembles an intravenous fluid bag, and having a clock 104 mounted on a face 106 of the block 102. In the illustrated embodiment, a portion 110 (FIG. 5) of the clock 104 is disposed within a cavity 112 formed within the block face 106. It is understood that the present invention is not limited to the illustrated clock 104. Various types, shapes, and configurations of clocks can be utilized in accordance with this embodiment of the present invention, without limitation. In addition, the cavity 112 may have various shapes and configurations to accommodate a clock, as would be understood by one skilled in the art.

Preferably, the block 102 includes an aperture 114 adjacent an end of the block 102, as illustrated. Accordingly, the block can be suspended via a stand as described above with respect to the embodiment of FIG. 1. Also, promotional indicia 116 may be disposed on the block 102. The block 102 may be formed from various materials including, but not limited to, glass, thermosetting polymers, and thermoplastic polymers.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A promotional apparatus, comprising;

a transparent, flexible, sealed, fluid filled intravenous fluid bag comprising promotional indicia, and an aperture adjacent an end thereof;

a clock mounted on the flexible intravenous fluid bag; and a stand, wherein the intravenous fluid bag is suspended from the stand via the aperture.

2. The promotional apparatus according to claim 1 wherein the clock comprises a digital display.

3. The promotional apparatus according to claim 1 wherein the stand further comprises a card holder.

4. A promotional apparatus, comprising:

two transparent, flexible polymeric sheet panels disposed substantially parallel to each other and joined along respective peripheral edges thereof to form a shape that resembles an intravenous fluid bag, wherein an aperture is formed through the panels;

a clock mounted on one of the flexible polymeric sheet panels; and a stand, wherein the panels are suspended from the stand via the aperture.

5. The promotional apparatus according to claim 4 wherein the clock comprises a digital display.

6. The promotional apparatus according to claim 4 wherein at least one of the two transparent polymeric sheet panels comprises promotional indicia thereon.

7. The promotional apparatus according to claim 4 further supported by the stand on a horizontal surface at an angle relative to the horizontal surface.

8. The promotional apparatus according to claim 4 wherein stand further comprises a card holder.

9. A promotional apparatus, comprising:

a transparent, flexible sealed, fluid filled intravenous fluid bag comprising promotional indicia;

a clock mounted on the flexible intravenous fluid bag; and a stand, wherein the intravenous fluid bag is supported by the stand on a horizontal surface at an angle relative to the horizontal surface.

10. The promotional apparatus according to claim 9 wherein the clock comprises a digital display.

* * * * *

UNITED STATES PATENT AND TRADEMARK OFFICE

CERTIFICATE OF CORRECTION

PATENT NO. : 6,766,604 B1
DATED : July 27, 2004
INVENTOR(S) : Jones

It is certified that error appears in the above-identified patent and that said Letters Patent is hereby corrected as shown below:

Column 4,
Line 40, should read -- wherein the stand further comprises a card holder. --

Signed and Sealed this

First Day of February, 2005

JON W. DUDAS
*Director of the United States Patent and Trademark Office*